US006689546B1

(12) United States Patent
LaBelle et al.

(10) Patent No.: US 6,689,546 B1
(45) Date of Patent: Feb. 10, 2004

(54) THERMALLY DEVELOPABLE MATERIALS CONTAINING BACKSIDE CONDUCTIVE LAYERS

(75) Inventors: Gary E. LaBelle, Stillwater, MN (US); Kumars Sakizadeh, Woodbury, MN (US); Thomas J. Ludemann, Maplewood, MN (US); Aparna V. Bhave, Woodbury, MN (US); Oanh V. Pham, Maplewood, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/304,225

(22) Filed: Nov. 26, 2002

(51) Int. Cl.[7] ..... G03C 1/498; G03C 1/89; G03C 1/93; G03C 5/29

(52) U.S. Cl. ..... 430/346; 430/353; 430/510; 430/517; 430/530; 430/531; 430/533; 430/534; 430/535; 430/536

(58) Field of Search ..... 430/530, 531, 430/553, 534, 535, 536, 346, 353, 510, 517

(56) References Cited

U.S. PATENT DOCUMENTS

| | | | | |
|---|---|---|---|---|
| 4,394,441 | A | 7/1983 | Kawaguchi et al. | |
| 4,418,141 | A | 11/1983 | Kawaguchi et al. | |
| 5,340,676 | A | 8/1994 | Anderson et al. | |
| 5,368,995 | A | 11/1994 | Christian et al. | 430/530 |
| 5,457,013 | A | 10/1995 | Christian et al. | 430/530 |
| 5,547,821 | A | 8/1996 | Melpolder et al. | |
| 5,731,119 | A | 3/1998 | Eichorst et al. | |
| 6,342,343 | B1 | 1/2002 | Toya | |
| 6,355,405 | B1 | 3/2002 | Ludemann et al. | 430/533 |
| 6,436,622 | B1 * | 8/2002 | Geisler | 430/531 |
| 6,464,413 | B2 | 10/2002 | Oyamada | |
| 6,479,227 | B1 | 11/2002 | Kubo et al. | |
| 2001/0055490 | A1 | 12/2001 | Oyamada | |

FOREIGN PATENT DOCUMENTS

| | | |
|---|---|---|
| JP | 71995-295146 | 11/1995 |

* cited by examiner

*Primary Examiner*—Richard L. Schilling
(74) *Attorney, Agent, or Firm*—J. Lanny Tucker; Louis M. Leichter

(57) ABSTRACT

Thermally developable materials that comprise a support have at least two backside layers. One of these layers can be a protective layer comprising a film-forming polymer. The materials also includes a non-imaging backside conductive layer comprising non-acicular metal antimonate particles in a mixture of two or more polymers that includes a first polymer serving to promote adhesion of the backside conductive layer directly to the support or other layers, and a second polymer that is different than and forms a single phase mixture with the first polymer.

29 Claims, No Drawings

THERMALLY DEVELOPABLE MATERIALS CONTAINING BACKSIDE CONDUCTIVE LAYERS

FIELD OF THE INVENTION

This invention relates to thermally developable materials containing certain backside conductive layers. In particular, the invention relates to thermographic and photothermographic materials containing metal antimonate conductive particles in backside conductive layers that are buried beneath a protective overcoat. The invention also relates to methods of imaging the thermally developable materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photosensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials are photosensitive materials that are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials,* (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure,* June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp. 67–70).

The silver halide may also be "preformed" and prepared by an "ex-situ " process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes,* E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

Many of the chemicals used to make supports or supported layers in thermally developable materials have electrically insulating properties, and electrostatic charges frequently build up on the materials during manufacture, packaging, and use. The accumulated charges can cause various problems. For example, in photothermographic materials containing photosensitive silver halides, accumulated electrostatic charge can generate light to which the silver halides are sensitive. This may result in imaging defects that are a particular problem where the images are used for medical diagnosis.

Build-up of electrostatic charge can also cause sheets of imageable material to stick together causing misfeeds and jamming within processing equipment. Additionally, accumulated electrostatic charge can attract dust or other particulate matter to the imageable material, thereby requiring more cleaning means so transport through the processing equipment and image quality of the material are not diminished.

Build-up of electrostatic charge also makes handling of developed sheets of imaged material more difficult. For example, a radiologist desires a static free sheet for viewing on the light boxes. This problem can be particularly severe when reviewing an imaged film that has been stored for a lengthy period of time because many antistatic materials loose their effectiveness over time.

In general, electrostatic charge is related to surface resistivity (measured in ohm/sq) and charge level. While electrostatic charge control agents (or antistatic agents) can be included in any layer of an imaging material, the accumulation of electrostatic charge can be prevented by reducing the surface resistivity or by lowering the charge level. This is usually done by including charge control agents in surface layers. Such surface layers may include what are known as "protective" overcoats or various backing layers in imaging materials. In thermographic and photothermographic materials, charge control agents may be incorporated into backing layers (such as antihalation layers of photothermographic materials) that are on the opposite side of the support as the imaging layers.

A wide variety of charge control agents, both inorganic and organic, have been devised and used for electrostatic charge control and numerous publications describe such agents. Some charge control agents are designed to increase surface layer conductivity while others are designed to control the generation of surface electrostatic charge.

U.S. Pat. No. 5,340,676 (Anderson et al.) describes the use of various metal oxides in conductive layers of various types of imaging elements. U.S. Published Application 2001-0055490 (Oyamada) describes the use of similar metal oxides dispersed in one or more binders on the backside layers of thermally developable materials.

Fine particle metal antimonates are used in conductive layers of imaging elements including thermal imaging elements described in U.S. Pat. No. 5,368,995 (Christian et al.) and U.S. Pat. No. 5,457,013 (Christian et al.). Various binders can be used in these conductive layers that can be located in various locations in the elements.

U.S. Pat. No. 5,731,119 (Eichorst et al.) describes the use of acicular metal oxides in conductive layers and further describes an antistatic composition containing granular zinc antimonate in a polyurethane binder.

U.S. Pat. No. 6,355,405 (Ludemann et al.) describes thermally developable materials that include adhesion-promoting layers on either side of the support. These adhesion-promoting layers are usually very thin, include specific mixtures of polymers to provide the adhesion function, and are also known as "carrier" layers. These layers can have a variety of other functions and may include materials that may improve coatability or adhesion, antihalation dyes, crosslinking agents (such as diisocyanates), surfactants and shelf-aging promoters.

Despite the considerable research and knowledge in the art relating to the use of various conductive compositions and imaging materials, there remains a need for conductive compositions that can be used on the backside of thermally developable imaging materials underneath the protective overcoats to provide improved shelf keeping properties and high conductivity.

SUMMARY OF THE INVENTION

The present invention provides a thermally developable material that comprises a support having on one side thereof, one or more thermally developable imaging layers comprising a binder and in reactive association, a non-photosensitive source of reducible silver ions, and a reducing agent composition for the non-photosensitive source reducible silver ions, and having disposed on the backside of the support:

a) a first layer comprising a film-forming polymer, and b) interposed between the support and the first layer and directly adhering the first layer to the support, a non-imaging backside conductive layer comprising non-acicular metal antimonate particles in a mixture of two or more polymers that include a first polymer serving to promote adhesion of the conductive layer directly to the support, and a second polymer that is different than and forms a single phase mixture with the first polymer, wherein the film-forming polymer of the first layer and the second polymer of the conductive layer are the same or different polyvinyl acetal resins, polyester resins, cellulosic polymers, maleic anhydride-ester copolymers, or vinyl polymers.

Thus, in some embodiments, this invention provides a photothermographic material that comprises a support having on one side thereof, one or more thermally developable imaging layers comprising a binder and in reactive association, a photosensitive silver halide, a non-photosensitive source of reducible silver ions, and a reducing composition for the non-photosensitive source reducible silver ions, and having disposed on the backside of the support:

a) a first layer comprising a film-forming polymer, and b) interposed between the support and the first layer and directly adhering the first layer to the support, a non-imaging backside conductive layer comprising non-acicular metal antimonate particles in a mixture of two or more polymers that include a first polymer serving to promote adhesion of the backside conductive layer directly to the support, and a second polymer that is different than and forms a single phase mixture with the first polymer, wherein the film-forming polymer of the first layer and the second polymer of the backside conductive layer are the same or different polyvinyl acetal resins, polyester resins, cellulosic polymers, maleic anhydride-ester copolymers, or vinyl polymers.

In one preferred embodiment, the present invention provides a black-and-white photothermographic material that comprises a transparent polymeric support having on one side thereof one or more thermally developable imaging layers comprising predominantly one or more hydrophobic binders including at least polyvinyl butyral, and in reactive association, a preformed photosensitive silver bromide or silver iodobromide present as tabular and/or cubic grains, a non-photosensitive source of reducible silver ions that includes one or more silver aliphatic carboxylates at least one of which is silver behenate, a reducing agent composition for the non-photosensitive source reducible silver ions comprising a hindered phenol or mixture thereof, and a protective layer disposed over the one or more thermally developable imaging layers, and having disposed on the backside of the support:

a) a backside protective layer comprising a film-forming polymer that is cellulose acetate butyrate, and b) interposed between the support and the backside protective layer and directly adhering the backside protective layer to the support, a non-imaging backside conductive layer comprising non-acicular metal antimonate particles in a mixture of two or more polymers that include a first polymer serving to promote adhesion of the backside conductive layer directly to the support, and a second polymer that is different than and forms a single phase mixture with the first polymer, wherein the first polymer of the backside conductive layer is a polyester and the second polymer of the backside conductive layer is cellulose acetate butyrate, and the non-acicular metal antimonate particles are composed of $ZnSb_2O_6$ and comprise from about 40 to about 55% by weight and are present in the backside conductive layer in an amount of from about 0.05 to about 2 g/m .

In another preferred embodiment, the present invention provides a black-and-white thermographic material that comprises a transparent polymeric support having on one side thereof one or more thermally developable imaging layers comprising predominantly one or more hydrophobic binders including at least polyvinyl butyral, and in reactive association, a non-photosensitive source of reducible silver ions that includes one or more silver aliphatic carboxylates at least one of which is silver behenate, a reducing agent composition for the non-photosensitive source reducible silver ions comprising an aromatic di- and tri-hydroxy compound having at least two hydroxy groups in ortho- or para-relationship on the same aromatic nucleus or mixture thereof, and a protective layer disposed over the one or more thermally developable imaging layers, and having disposed on the backside of the support:

a) a backside protective layer comprising a film-forming polymer that is cellulose acetate butyrate, and b) interposed between the support and the backside protective layer and directly adhering the backside protective layer to the support, a non-imaging backside conductive layer comprising non-acicular metal antimonate particles in a mixture of two or more polymers that include a first polymer serving to promote adhesion of the backside conductive layer directly to the support, and a second polymer that is different than and forms a single phase mixture with the first polymer, wherein the first polymer of the backside conductive layer is a polyester and the second polymer of the backside conductive layer is polyvinyl butyral or cellulose acetate butyrate and the non-acicular metal antimonate particles are composed of $ZnSb_2O_6$ and comprise from about 40 to about 55% by weight of the buried backside conductive layer and are present in the conductive layer in an amount of from about 0.05 to about 2 $g/m^2$.

The present invention provides a thermally developable material that comprises a support having on one side thereof, one or more thermally developable imaging layers comprising a binder and in reactive association, a non-photosensitive source of reducible silver ions, and a reducing agent composition for the non-photosensitive source reducible silver ions, and having disposed on the backside of the support:

a) a first layer comprising a film-forming polymer, b) a second layer directly adhered to the support, comprising a mixture of two or more polymers that includes a first polymer serving to promote adhesion of the second layer directly to the support, and a second polymer that is different than and forms a single phase mixture with the first polymer, and c) interposed between the first layer and the second layer, a non-imaging backside conductive layer comprising non-acicular metal antimonate particles in a polymer serving to promote adhesion of the backside conductive layer directly to the first and second layers, wherein the film-forming polymer of the first layer, the polymer of the conductive layer, and the second polymer of the second layer are the same or different polyvinyl acetal resins, polyester resins, cellulosic polymers, maleic anhydride-ester copolymers, or vinyl polymers.

The present invention provides a thermally developable material that comprises a support having on one side thereof, one or more thermally developable imaging layers comprising a binder and in reactive association, a non-photosensitive source of reducible silver ions, and a reducing agent composition for the non-photosensitive source reducible silver ions, and having disposed on the backside of the support:

a) a first layer comprising a film-forming polymer, b) a second layer directly adhered to the support, comprising a first polymer, and c) interposed between the first layer and the second layer, a non-imaging backside conductive layer comprising non-acicular metal antimonate particles in a mixture of two or more polymers that includes the first polymer that serves to promote adhesion to the second layer, and a second polymer that is different than and forms a single phase mixture with the first polymer, and serves to promote adhesion to the first layer, wherein the film-forming polymer of the first layer and one of the two or more polymers of the backside conductive layer are the same or different polyvinyl acetal resins, polyester resins, cellulosic polymers, maleic anhydride-ester copolymers, or vinyl polymers.

Further, the present invention provides a method of forming a visible image comprising:

a) imagewise exposing a photothermographic material of the present invention to electromagnetic radiation to form a latent image, b) simultaneously or sequentially, heating the exposed photothermographic material to develop the latent image into a visible image.

In embodiments wherein the thermally developable material of the present invention is a thermographic material, a method of forming a visible image comprises thermal imaging of the thermally developable material.

In some embodiments wherein the thermographic or photothermographic material comprises a transparent support, the image-forming method further comprises:

c) positioning the exposed and heat-developed photothermographic material with the visible image thereon between a source of imaging radiation and an imageable material that is sensitive to the imaging radiation, and d) thereafter exposing the imageable material to the imaging radiation through the visible image in the exposed and heat-developed photothermographic material to provide an image in the imageable material.

The present invention provides a number of advantages with the use of specific metal antimonates on the backside of the thermally developable materials. More specifically, the backside conductive layer is located underneath other layers such as an outermost protective layer so the conductive layer provides both conductivity as well as adhesion while the other layers can be designed with other properties. Since the conductive layer is "buried" under the other layers, it is protected from dirt, dust, and fingerprints. The other layer (identified herein as the "first" layer) can be composed of different but "compatible" polymers and provide antihalation, physical and chemical protection and improved film transport.

Moreover, we have found that if the backside conductive layer is "buried," the efficiency of the metal antimonate particles is improved. That is, fewer conductive particles are needed than when they are incorporated into the outermost layer. Also, by controlling the thickness of, or the amount of the metal antimonate in this "buried" layer, the conductivity of the layer can be more readily adjusted. Additionally, when the backside conductive layer is "buried," lower $D_{min}$ values can be obtained. Furthermore, use of metal antimonate particles in a "buried" backside conductive layer has been found to reduce penetration of superposed layers into the coating slot of the "buried" backside conductive layer during slide coating.

DETAILED DESCRIPTION OF THE INVENTION

The thermally developable materials of this invention include both thermographic and photothermographic materials. While the following discussion will often be directed primarily to the preferred photothermographic embodiments, it would be readily understood by one skilled in the imaging arts that thermographic materials can be similarly constructed (using one or more imaging layers) and used to provide black-and-white or color images using non-photosensitive silver salts, reducing compositions, binders, and other components known to be useful in such embodiments. In both thermographic and photothermographic materials, the non-acicular metal antimonate particles described herein are generally incorporated into a separate conductive ("antistatic") layer on at least the backside and optionally on both sides of the support.

The thermographic and photothermographic materials of this invention can be used in black-and-white or color thermography or photothermography and in electronically generated black-and-white or color hardcopy recording. They can be used in microfilm applications, in radiographic imaging (for example digital medical imaging), X-ray radiography, and in industrial radiography. Furthermore, the absorbance of these thermographic and photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermographic and photothermographic materials of this invention are particularly useful for medical imaging of human or animal subjects in response to visible or X-radiation. Such applications include, but are not limited to, thoracic imaging, mammography, dental imaging, orthopedic imaging, general medical radiography, therapeutic radiography, veterinary radiography, and auto-radiography. When used with X-radiation, the photothermographic materials of this invention may be used in combination with one or more phosphor intensifying screens, with phosphors incorporated within the photothermographic emulsion, or with a combination thereof. The materials of this invention are also useful for non-medical uses of visible or X-radiation (such as X-ray lithography and industrial radiography).

The photothermographic materials of this invention can be made sensitive to radiation of any suitable wavelength. Thus, in some embodiments, the materials are sensitive at ultraviolet, visible, infrared or near infrared wavelengths, of the electromagnetic spectrum. In preferred embodiments, the materials are sensitive to radiation greater than 700 nm (and generally up to 1150 $\mu$m). In other embodiments they are sensitive to X-radiation. Increased sensitivity to a particular region of the spectrum is imparted through the use of various sensitizing dyes.

The photothermographic materials of this invention are also useful for non-medical uses of visible or X-radiation (such as X-ray lithography and industrial radiography). In such imaging applications, it is often desirable that the photothermographic materials be "double-sided."

In the photothermographic materials of this invention, the components needed for imaging can be in one or more thermally developable layers on one side ("frontside") of the support. The layer(s) that contain the photosensitive photocatalyst (such as a photosensitive silver halide in photothermographic materials) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer.

Similarly, in the thermographic materials of this invention, the components needed for imaging can be in one or more layers. The layer(s) that contain the non-photosensitive source of reducible silver ions are referred to herein as thermographic emulsion layer(s).

Where the materials contain imaging layers on one side of the support only, various non-imaging layers are usually disposed on the "backside" (non-emulsion or non-imaging side) of the materials, including at least one conductive layer described herein, and optionally antihalation layer(s), protective layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some applications it may be useful that the photothermographic materials be "double-sided" and have photothermographic coatings on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the thermographic and photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component (for example, the specific metal antimonates in the backside conductive layer).

The term "polymer" when referring to polymeric materials is defined to include homopolymers, copolymers and terpolymers.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process,* Fourth Edition, Eastman Kodak Company, Rochester, N.Y., 1977, p. 374.

"Photothermographic material(s)" means a construction comprising at least one photothermographic emulsion layer or a photothermographic set of layers, wherein the photosensitive silver halide and the source of reducible silver ions are in one layer and the other essential components or desirable additives are distributed, as desired, in the same layer or in an adjacent coating layer, as well as any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Thermographic materials" are similarly defined except that no photosensitive silver halide is present.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads.

"Catalytic proximity" or "reactive association" means that the materials are in the same layer or in adjacent layers so that they readily come into contact with each other during thermal imaging and development.

"Emulsion layer," "imaging layer," "thermographic emulsion layer," or "photothermographic emulsion layer," means a layer of a thermographic or photothermographic material that contains the photosensitive silver halide (when used) and/or non-photosensitive source of reducible silver ions. It can also mean a layer of the thermographic or photothermographic material that contains, in addition to the photosensitive silver halide (when used) and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

Some of the materials used herein are provided as a solution or dispersion. The term "active ingredient" or "active solids" means the amount or the percentage of the desired material contained in a sample. All amounts listed herein are the amount of active ingredient added unless otherwise specified.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), absorbance, contrast, $D_{min}$, and $D_{max}$ have conventional definitions known, in the imaging arts. In photothermographic materials, $D_{min}$ is considered herein as image density achieved when the photothermographic material is thermally developed without prior exposure to radiation. It is the average of eight lowest density values on the exposed side of the fiducial mark. In thermographic materials, $D_{min}$ is considered herein as image density in the non-thermally imaged areas of the thermographic material.

The sensitometric term absorbance is another term for optical density (OD).

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support.

The term "buried layer" means that there is at least one other layer disposed over the backside conductive layer(s).

In the compounds described herein, no particular double bond geometry (for example, cis or trans) is intended by the structures drawn. Similarly, in compounds having alternating single and double bonds and localized charges are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

Research Disclosure is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver iodobromide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mol % silver iodide. Typical techniques for preparing and precipitating silver halide grains are described in *Research Disclosure,* 1978, item 17643.

In some embodiments of aqueous-based photothermographic materials, higher amounts of iodide may be present in homogeneous photosensitive silver halide grains, and particularly from about 20 mol % up to the saturation limit of iodide as described, for example, in copending and commonly assigned U.S. Ser. No. 10/246,265 (filed Sep. 18, 2002 by Maskasky and Scaccia).

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process,* Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Mixtures of both preformed and in-situ generated silver halide may be used if desired.

Additional methods of preparing these silver halide and organic silver salts and manners of blending them are described in *Research Disclosure,* June 1978, item 17029, U.S. Pat. No. 3,700,458 (Lindholm), U.S. Pat. No. 4,076,539 (Ikenoue et al.), JP 49-013224 A, (Fuji), 50-017216 A (Fuji), and 51-042529 A (Fuji).

In some instances, it may be helpful to prepare the photosensitive silver halide grains in the presence of a hydroxytetraazaindene (such as 4-hydroxy-6-methyl-1,3,3a,7-tetraazaindene or an N-heterocyclic compound comprising at least one mercapto group (such as 1-phenyl-5-mercaptotetrazole) to provide increased photospeed. Details of this procedure are provided in U.S. Pat. No. 6,413,710B1 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in photothermographic features of the invention may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process,* Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and EP 0 915 371 A1 (Lok et al.), all of which are incorporated herein by reference.

In addition, mercaptotetrazoles and tetraazindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature for a predetermined time. Various sulfur compounds can be used. Some examples of sulfur sensitizers include thiosulfates, thioureas, thioamides, thiazoles, rhodanines, phosphine sulfides, thiohydantoins, 4-oxo-oxazolidine-2-thiones, dipolysulfides, mercapto compounds, polythionates, and elemental sulfur.

Certain tetrasubstituted thiourea compounds are also useful in the present invention. Such compounds are described, for example in U.S. Pat. No. 6,296,998 (Eikenberry et al.), U.S. Pat. No. 6,322,961 (Lam et al.) and U.S. Pat. No. 6,368,779 (Lynch et al.). Also useful are the tetrasubstituted middle chalcogen (that is, sulfur, selenium, and tellurium) thiourea compounds disclosed in U.S. Pat. No. 4,810,626 (Burgmaier et al.). All of the above patents are incorporated herein by reference.

The amount of the sulfur sensitizer to be added varies depending upon various conditions such as pH, temperature and grain size of silver halide at the time of chemical ripening, it is preferably from $10^{-7}$ to $10^{-2}$ mole per mole of silver halide, and more preferably from $10^{-6}$ to $10^{-4}$ mole.

In one preferred embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

Still other useful chemical sensitizers include certain selenium-containing compounds. When used, selenium sensitization is usually performed by adding a selenium sensitizer and stirring the emulsion at an appropriate temperature for a predetermined time. Some specific examples of useful selenium compounds can be found in U.S. Pat. No. 5,158,892 (Sasaki et al.), U.S. Pat. No. 5,238,807 (Sasaki et al.), U.S. Pat. No. 5,942,384 (Arai et al.) and in co-pending and commonly assigned U.S. Ser. No. 10/082,516 (filed Feb. 25, 2002 by Lynch, Opatz, Gysling, and Simpson). All of the above documents are incorporated herein by reference.

Still other useful chemical sensitizers include certain tellurium-containing compounds. When used, tellurium sensitization is usually performed by adding a tellurium sensitizer and stirring the emulsion at an appropriate temperature for a predetermined time. Tellurium compounds for use as chemical sensitizers can be selected from those described in *J. Chem. Soc,. Chem. Commun.* 1980, 635, ibid., 1979, 1102, ibid., 1979, 645, *J. Chem. Soc. Perkin. Trans,* 1980, 1, 2191, *The Chemistry of Organic Selenium and Tellurium Compounds,* S. Patai and Z. Rappoport, Eds., Vol. 1 (1986), and Vol. 2 (1987), U.S. Pat. No. 1,623,499 (Sheppard et al.), U.S. Pat. No. 3,320,069 (Illingsworth), U.S. Pat. No. 3,772,031 (Berry et al.), U.S. Pat. No. 5,215,880 (Kojima et al.), U.S. Pat. No. 5,273,874 (Kojima et al.), U.S. Pat. No. 5,342,750 (Sasaki et al.), U.S. Pat. No. 5,677,120 (Lushington et al.), British Pat. No. 235,211 (Sheppard), British Pat. No. 1,121,496 (Halwig), British Pat. No. 1,295,462 (Hilson et al.), British Pat. No. 1,396,696 (Simons), JP-04-271341 A (Morio et al.), in co-pending and commonly assigned U.S. Published Application 2002-0164549 (Lynch et al.), and in co-pending and commonly assigned U.S. Ser. No. 09/923,039 (filed Aug. 6, 2001 by Gysling, Dickinson, Lelental, and Boettcher). All of the above documents are incorporated herein by reference.

The amount of the selenium or tellurium sensitizer used in the present invention varies depending on silver halide grains used or chemical ripening conditions. However, it is generally from $10^{-8}$ to $10^{-2}$ mole per mole of silver halide, preferably on the order of from $10^{-7}$ to $10^{-3}$ mole.

Noble metal sensitizers for use in the present invention include gold, platinum, palladium and iridium. Gold sensitization is particularly preferred.

When used, the gold sensitizer used for the gold sensitization of the silver halide emulsion used in the present invention may have an oxidation number of 1 or 3, and may be a gold compound commonly used as a gold sensitizer. U.S. Pat. No. 5,858,637 (Eshelman et al.) describes various Au (I) compounds that can be used as chemical sensitizers. Other useful gold compounds can be found in U.S. Pat. No. 5,759,761 (Lushington et al.). Useful combinations of gold (I) complexes and rapid sulfiding agents are described in U.S. Pat. No. 6,322,961 (Lam et al.). Combinations of gold (III) compounds and either sulfur- or tellurium-containing compounds are useful as chemical sensitizers and are described in U.S. Pat. No. 6,423,481 (Simpson et al.). All of the above references are incorporated herein by reference.

Reduction sensitization may also be used. Specific examples of compounds useful in reduction sensitization include, but are not limited to, stannous chloride, hydrazine ethanolamine, and thioureaoxide. Reduction sensitization may be performed by ripening the grains while keeping the emulsion at pH 7 or above, or at pAg 8.3 or less.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, merocyanine dyes and complex merocyanine dyes are particularly useful. Spectral sensitizing dyes are chosen for optimum photosensitivity, stability, and synthetic ease. They may be added at any stage in chemical finishing of the photothermographic emulsion.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP 2000-063690 (Tanaka et al.), JP 2000-112054 (Fukusaka et al.), JP 2000-273329 (Tanaka et al.), JP 2001-005145 (Arai), JP 2001-064527 (Oshiyama et al.), and JP 2001-154305 (Kita et al.), can be used in the practice of the invention. All of the publications noted above are incorporated herein by reference. A summary of generally useful spectral sensitizing dyes is contained in *Research Disclosure,* item 308119, Section IV, December, 1989. Additional classes of dyes useful for spectral sensitization, including sensitization at other wavelengths are described in *Research Disclosure,* 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications are incorporated herein by reference.

Specific examples of useful spectral sensitizing dyes for the photothermographic materials of this invention include, for example, 2-[[5-chloro-3-(3-sulfopropyl)-2(3H)-benzothiazolylidene]methyl]-1-(3-sulfopropyl)-naphtho[1,2-d]thiazolium, inner salt, N,N-diethylethanamine salt (1:1), 2-[[5,6-dichloro-1-ethyl-1,3-dihydro-3-(3-sulfopropyl)-2H-benzimidazol-2-ylidene]methyl]-5-phenyl-3-(3-sulfopropyl)-benzoxazolium, inner salt, potassium salt, 5-chloro-2-[[5-chloro-3-(3-sulfopropyl)-2(3H)-benzothiazolylidene]methyl]-3-(3-sulfopropyl)-benzothiazolium, inner salt, N,N-diethylethanamine salt (1:1), and 5-phenyl-2-((5-phenyl-3-(3-sulfopropyl)-2(3H)-benzoxazolylidene)methyl)-3-(3-sulfopropyl)-benzothiazolium, inner salt, N,N-diethylethanamine salt (1:1).

Also useful are spectral sensitizing dyes that decolorize by the action of light or heat. Such dyes are described in U.S. Pat. No. 4,524,128 (Edwards et al.), JP 2001-109101 (Adachi), JP 2001-154305 (Kita et al.), and JP 2001-183770 (Hanyu et al.).

Spectral sensitizing dyes may be used singly or in combination. The dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermographic and photothermographic materials of this invention can be any metal-organic compound that contains reducible silver (1+) ions. Such compounds are generally silver salts of silver coordinating ligands. Preferably, it is an organic silver salt that is comparatively stable to light and forms a silver image when heated to 50° C. or higher in the presence of an exposed photocatalyst (such as silver halide, when used in a photothermographic material) and a reducing composition.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative examples of useful silver salts of aromatic carboxylic acid and other carboxylic acid group-containing compounds include, but are not limited to, silver benzoate, silver substituted-benzoates (such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Silver salts of sulfonates are also useful in the practice of this invention. Such materials are described for example in U.S. Pat. No. 4,504,575 (Lee). Silver salts of sulfosuccinates are also useful as described for example in EP 0 227 141 A1 (Leenders et al.).

Moreover, silver salts of acetylenes can also be used as described, for example in U.S. Pat. No. 4,761,361 (Ozaki et al.) and U.S. Pat. No. 4,775,613 (Hirai et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group is preferred, especially in aqueous-based imaging formulations. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is often used in aqueous-based thermographic and photothermographic formulations.

Organic silver salts that are particularly useful in organic solvent-based photothermographic materials include silver carboxylates (both aliphatic and aromatic carboxylates), silver triazolates, silver sulfonates, silver sulfosuccinates, and silver acetylides. Silver salts of long-chain aliphatic carboxylic acids containing 15 to 28, carbon atoms and silver salts are particularly preferred.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque thermographic and photothermographic materials, different amounts can be used.

The methods used for making silver soap emulsions are well known in the art and are disclosed in *Research Disclosure, April* 1983, item 22812, *Research Disclosure,* October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Another useful source of non-photosensitive reducible silver ions in the practice of this invention are the silver dimer compounds that comprise two different silver salts as described in copending and commonly assigned U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter), that is incorporated herein by reference.

As one skilled in the art would understand, the non-photosensitive source of reducible silver ions can include various mixtures of the various silver salt compounds described herein, in any desirable proportions.

When used in photothermographic materials, the photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the thermographic and photothermographic materials is generally at least 0.002 mol/m$^2$ and preferably from about 0.01 to about 0.05 mol/m$^2$.

Reducing Agent Compositions

When used in a photothermographic material, the reducing agent (or reducing agent composition comprising two or more components) for the source of reducible silver ions can be any material, preferably an organic material, that can reduce silver (1+) ion to metallic silver.

Conventional photographic developers can be used as reducing agents, including aromatic di- and tri-hydroxy compounds (such as hydroquinones, gallatic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When a silver benzotriazole silver source is used, ascorbic acid reducing agents are preferred. An "ascorbic acid" reducing agent (also referred to as a developer or developing agent) means ascorbic acid, complexes, and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792 A1 (Passarella et al.), EP 0 573 700 A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure,* item 37152, March 1995. D-, L-, or D,L-ascorbic acid (and alkali metal salts thereof) or isoascorbic acid (or alkali metal salts thereof) are preferred. Mixtures of these developing agents can be used if desired.

When a silver carboxylate silver source is used in a photothermographic material, hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below. Hindered phenol reducing agents are preferred (alone or in combination with one or more high-contrast co-developing agents and co-developer contrast enhancing agents).

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl)methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl)

methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), that is incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3 (2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- orpara-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are reducing catechol-type reducing agents having no more than two hydroxy groups in an ortho-relationship. Preferred catechol-type reducing agents include, for example, catechol, 3-(3,4-dihydroxy-phenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxybenzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II).

Aromatic di- and tri-hydroxy reducing agents can also be used in combination with hindered phenol reducing agents either together or in or in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP 59-165,054 (Fuji).

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbance are provided in U.S. Pat. No. 5,491,059 (noted above, Col. 14).

The total amount of one or more dye- forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The thermographic and photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228B1 (Philip Jr. et al.), incorporated herein by reference.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,281,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP 0 600 586A1 (Philip, Jr. et al.), and tribromomethylketones as described, for example, in EP 0 600 587A1 (Oliffet al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

Advantageously, the photothermographic materials of this invention also include one or more thermal solvents (or melt formers). Representative examples of such compounds include, but are not limited to, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, dimethylurea, D-sorbitol, and benzenesulfonamide. Combinations of these compounds can also be used including a combination of succinimide and dimethylurea. Known thermal solvents are disclosed, for example, in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials according to the invention to provide improved and more effective image development. A base-release agent or base precursor as employed herein is intended to include compounds which upon heating in the photothermographic material provide a more effective reaction between the described photosensitive silver halide, and the image-forming combination comprising a silver salt and the silver halide developing agent. Representative base-release agents or base precursors include guanidinium compounds, such as guanidinium trichloroacetate, and other compounds that are known to release a base but do not adversely affect photographic silver halide materials, such as phenylsulfonyl acetates. Further details are provided in U.S. Pat. No. 4,123,274 (Knight et al.).

A range of concentration of the base-release agent or base precursor is useful in the described photothermographic materials. The optimum concentration of base-release agent or base precursor will depend upon such factors as the desired image, particular components in the photothermographic material, and processing conditions.

The use of "toners" or derivatives thereof that improve the image are highly desirable components of the thermographic and photothermographic materials of this invention. Toners are compounds that when added to the imaging layer shift the color of the developed silver image from yellowish-orange to brown-black or blue-black. Generally, one or more toners described herein are present in an amount of about 0.01 % by weight to about 10%, and more preferably about 0.1% by weight to about 10% by weight, based on the total dry weight of the layer in which it is included. Toners may be incorporated in the photothermographic emulsion layer or in an adjacent layer.

Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and copending and commonly assigned U.S. Ser. No. 10/193,443 (filed Jul. 11, 2002 by Lynch, Zou, and Ulrich) and U.S. Ser. No. 10/192,944 (filed Jul. 11, 2002 by Lynch, Ulrich, and Zou), all of which are incorporated herein by reference.

The photothermographic materials of this invention can also include one or more image stabilizing compounds that are usually incorporated in a "backside" layer. Such compounds can include, but are not limited to, phthalazinone and its derivatives, pyridazine and its derivatives, benzoxazine and benzoxazine derivatives, benzothiazine dione and its derivatives, and quinazoline dione and its derivatives, particularly as described in copending and commonly assigned U.S. Ser. No. 10/041,386 (filed Jan. 8, 2002 by Kong). Other useful backside image stabilizers include, but are not limited to, anthracene compounds, coumarin compounds, benzophenone compounds, benzotriazole compounds, naphthalic acid imide compounds, pyrazoline compounds, or compounds described for example, in U.S. Pat. No. 6,465,162 (Kong et al.) and GB 1,565,043 (Fuji Photo). All of these patents and patent applications are incorporated herein by reference.

Binders

The photosensitive silver halide (when used), the non-photosensitive source of reducible silver ions, the reducing agent composition described above, and any other imaging layer additives used in the present invention are generally added to one or more binders that are either hydrophilic or hydrophobic. Thus, either aqueous or organic solvent-based formulations can be used to prepare the thermally developable materials of this invention. Mixtures of either or both types of binders can also be used. It is preferred that the binder be selected from hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 and PIOLOFORM® BS-18 or PIOLOFORM® BL-16. Aqueous dispersions (or latexes) of hydrophobic binders may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure,* item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP 0 600 586 B1 (Philip, Jr. et al.) and vinyl sulfone compounds as described in U.S. Pat. No. 6,143,487 (Philip, Jr. et al.), and EP 0 640

589 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process,* Fourth Edition, Eastman Kodak Company, Rochester, N.Y., 1977, Chapter 2, pp. 77–8.

Where the proportions and activities of the thermographic and photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. The effective range of amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

It is particularly useful in the thermally developable materials of this invention to use predominantly (more than 50% by weight of total binder weight) hydrophobic binders in both imaging and non-imaging layers on the side of the support having the imaging layer(s).

Support Materials

The thermally developable materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure,* 1979, item 18431. A method of making dimensionally stable polyester films is described in *Research Disclosure,* 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in WO 02/21208 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. For example, the support can contain conventional blue dyes that differ in absorbance from colorants in the various frontside or backside layers, for example as described in U.S. Pat. No. 6,248,442 (Van Achere et al.). Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Thermographic and Photothermographic Formulations

An organic-based formulation for the thermographic and photothermographic emulsion layer(s) can be prepared by dissolving and dispersing the binder, the photocatalyst (when used), the source of non-photosensitive silver ions, the reducing composition, toner(s), and optional addenda in an organic solvent, such as toluene, 2-butanone (methyl ethyl ketone), acetone, or tetrahydrofuran.

Alternatively, the desired imaging components can be formulated with a hydrophilic binder (such as gelatin, a gelatin-derivative, or a latex) in water or water-organic solvent mixtures to provide aqueous-based coating formulations.

Thermographic and photothermographic materials of the invention can contain plasticizers and lubricants such as poly(alcohols) and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The thermographic and photothermographic materials of this invention can be constructed of one or more layers on the imaging side of the support. Single layer materials should contain the photocatalyst, the non-photosensitive source of reducible silver ions, the reducing agent composition, the binder, as well as optional materials such as toners, acutance dyes, coating aids, and other adjuvants.

Two-layer constructions comprising a single imaging layer coating containing all the ingredients and a surface protective topcoat are generally found on the frontside of the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in thermographic and photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102B1 (Bauer et al.), all incorporated herein by reference.

Thermographic and photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.), incorporated herein by reference.

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are simultaneously applied to a film support using slide coating. The first and second fluids used to coat these layers can be the same or different solvents (or solvent mixtures).

While the first and second layers can be coated on one side of the film support, manufacturing methods can also include forming on the opposing or backside of said polymeric support, one or more additional layers, including the required conductive layer, and optionally an antihalation layer or a layer containing a matting agent (such as silica), or a combination of such layers.

It is also contemplated that the photothermographic materials of this invention can include emulsion layers on both sides of the support. Such constructions can further include at least one infrared radiation absorbing heat-bleachable compositions as an antihalation underlayer beneath at least one emulsion layer.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation compositions may be incorporated into one or more antihalation layers according to known techniques, as an antihalation backing layer, as an antihalation underlayer, or as an antihalation overcoat. Additionally, one or more antihalation or acutance dyes may be incorporated into one or more frontside layers such as the photothermographic emulsion layer, carrier layer, primer layer, underlayer, or topcoat layer according to known techniques. It is preferred that the photothermographic materials of this invention contain an antihalation composition on the backside of the support, and more preferably in the backside topcoat layer.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), the indolenine dyes described in EP 0 342 810A1 (Leichter), and the cyanine dyes described in copending and commonly assigned U.S. Ser. No. 10/01 1,892 (filed Dec. 5, 2001 by Hunt, Kong, Ramsden, and LaBelle). All of the above references are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP Kokai 2001-142175 (Hanyu et al.), and JP Kokai 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), and JP Kokai 2000-029168 (Noro). All of the above publications are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Ser. No. 09/875,772 (filed Jun. 6, 2001 by Goswami, Ramsden, Zielinski, Baird, Weinstein, Helber, and Lynch), and U.S. Ser. No. 09/944, 573 (filed Aug. 31, 2001 by Ramsden and Baird), all incorporated herein by reference.

Under practical conditions of use, the compositions are heated to provide bleaching at a temperature of at least 90° C. for at least 0.5 seconds. Preferably, bleaching is carried out at a temperature of from about 1 00° C. to about 200° C. for from about 5 to about 20 seconds. Most preferred bleaching is carried out within 20 seconds at a temperature of from about 110° C. to about 130° C.

In some embodiments, the photothermographic materials of this invention comprise one or more acutance dyes in the one or more thermally developable imaging layers. In some embodiments the photothermographic materials comprise one or more antihalation dyes in the one or more non-imaging layers on the imaging side of the support. In some embodiments, the photothermographic materials of this invention comprise one or more antihalation dyes in the backside layer on the support, and more preferably in the backside topcoat layer. Such non-imaging layers include, for example, carrier layers, primer layers, barrier layers, or topcoat layers.

Some materials of the present invention may have an optical density at a wavelength close to that of the exposure of from about 0.2 to about 3 on the imaging side of the support, and an optical density of up to 2 on the backside of the support, as measured using a conventional spectrophotometer.

In preferred embodiments, the thermally developable materials of this invention include a surface protective layer on the same side of the support as the one or more thermally-developable layers and a conductive layer on the back side of the support underneath a protective layer that can also include an antihalation composition.

Conductive Compositions/Layers

The essential feature of the present invention is the presence of at least one conductive layer on the backside (non-imaging side) of the support that includes one or more specific non-acicular metal antimonate particles having a composition represented by the following Structure I or II:

$$M^{+2}Sb^{+5}{}_2O_6 \quad (I)$$

wherein M is zinc, nickel, magnesium, iron, copper, manganese, or cobalt, $$M_a{}^{+3}Sb^{+5}O_4 \quad (II)$$

wherein $M_a$ is indium, aluminum, scandium, chromium, iron, or gallium.

Thus, these particles are generally metal oxides that are doped with antimony.

Preferably, the non-acicular metal antimonate particles are composed of $ZnSb_2O_6$. Several conductive metal antimonates are commercially available from Nissan Chemical America Corporation including the preferred $ZnSb_2O_6$ non-acicular particles that are available as a 40% (solids) organosol dispersion under the tradename CELNAX® CX-Z401M.

Alternatively, the metal antimonate particles can be prepared using methods described for example in U.S. Pat. No. 5,457,013 (noted above) and references cited therein.

The metal antimonate particles in the backside conductive layer are predominately (more than 40% by weight of total particles) in the form of non-acicular particles as opposed to "acicular" particles. By "non-acicular" particles is meant not needlelike, that is, not acicular. Thus, the shape of the metal antimonate particles can be granular, spherical, ovoid, cubic, rhombic, tabular, tetrahedral, octahedral, icosahedral, truncated cubic, truncated rhombic, or any other non-needle like shape.

Generally, these metal particles have an average diameter of from about 15 to about 20 nm as measured across the largest particle dimension using the BET method.

The non-acicular metal antimonate particles generally comprise from about 40 to about 55% (preferably from about 40 to about 50%) by weight of the buried backside conductive layer. Another way of defining the amount of particles is that they are generally present in the backside conductive layer in an amount of from about 0.05 to about 2 g/m$^2$. Mixtures of different types of non-acicular metal antimonate particles can be used if desired.

The non-acicular metal antimonate particles are also generally present in an amount sufficient to provide a backside surface resistivity measured at 70° F. (21.1° C.) and 20% relative humidity of $4\times10^{12}$ ohms/sq or less, a static decay time of 0.02 seconds, or a wet electrode resistivity of $1\times10^{12}$ ohms/sq or less and preferably $1\times10^{10}$ ohms/sq or less as measured using the techniques and procedures described herein.

An essential aspect of the present invention is the fact that the conductive metal antimonate particles are present in one or more backside conductive layers that are "buried" on the backside of the support, meaning that there is at least one other layer disposed over the backside conductive layer(s). Moreover, the relationship of the backside conductive layer (s), and the layer or layers immediately adjacent is important because the types of polymers and binders in these layers are designed to provide excellent adhesion to one another as well as acceptably dispersing the conductive metal antimonate particles and/or or layer components, and are readily coated simultaneously or separately.

The "buried" backside conductive layer may also be relatively thin in comparison to other layers on the backside, and in such instances, it can have a dry thickness of less than 2 $\mu$m, and preferably a dry thickness of from about 0.06 to about 2 $\mu$m. Because of these useful features, the "buried" backside conductive layer is useful as a "carrier" layer. The term "carrier layer" is often used when multiple layers are coated using slide coating and the buried backside conductive layer is a thin layer adjacent to the support.

In one preferred embodiment, the backside conductive layer is directly disposed on the support without the use of primer or subbing layers, or other adhesion-promoting means such as support surface treatments. Thus, the support can be used in an "untreated" and "uncoated" form when a buried backside conductive layer is used.

The layer directly disposed over the conductive layers is known herein as a "first" layer and can be known as a "protective" layer that can be the outermost topcoat layer or have further layer(s) disposed thereon. This first layer comprises a film-forming polymer. The backside conductive layer immediately underneath comprises the non-acicular metal antimonate particles in a mixture of two or more polymers that includes a "first" polymer serving to promote adhesion of the backside conductive layer directly to the polymeric support, and a "second" polymer that is different than and forms a single phase mixture with the first polymer.

It is preferred that film-forming polymer of the first layer and the second polymer of the backside conductive layer are the same or different polyvinyl acetal resins, polyester resins, cellulosic polymers, maleic anhydrideester copolymers, or vinyl polymers. It is more preferred that the film-forming polymer of the first layer and the second polymer of the backside conductive layer is a polyvinyl acetal such as polyvinyl butyral or cellulose ester such as cellulose acetate butyrate. It is preferred that the "first" polymer of the backside conductive layer is a polyester resin. It is most preferred that the backside conductive layer use a single phase mixture of a polyester resin as a "first" polymer and cellulose acetate butyrate as a "second" polymer."

It is preferred to use a mixture of polymers, that is, a first polymer that promotes adhesion to the support and a second polymer that promotes adhesion to the first layer. For example, when the support is a polyester film, and the backside conductive layer contains a polyvinyl acetal or a cellulose ester, then a preferred mixture of polymers in that conductive layer is a single phase mixture of a polyester resin and a polyvinyl acetal such as polyvinyl butyral or cellulose ester such as cellulose acetate butyrate.

In another embodiment, the buried backside conductive layer is disposed between a "first" layer and a "second" layer directly adhering the support. In this embodiment, the "first" layer is directly above the backside conductive layer and is known herein as a "first" layer, a "protective" layer, or a "protective topcoat" layer. It can be the outermost topcoat layer or have further layer(s) disposed thereon. This first layer comprises a film-forming polymer. The conductive layer immediately beneath the first layer comprises the non-acicular metal antimonate particles in a polymer that serves to promote adhesion of the backside conductive layer to the first layer as well as to a "second" layer immediately beneath it. This second layer is directly adhered to the polymeric support. The second layer directly adhered to the support comprises a mixture of two or more polymers. The first polymer serves to promote adhesion of the second layer directly to the polymeric support. The second polymer serves to promote adhesion of the second layer to the backside conductive layer.

It is preferred that the film-forming polymer of the first layer, the polymer of the backside conductive layer, and the second polymer of the second layer are the same or different polyvinyl acetal resins, polyester resins, cellulosic ester polymers, maleic anhydride-ester copolymers, or vinyl polymers. A preferred polymer is cellulose acetate butyrate.

It is preferred that the second, adhesion-promoting, layer use a single phase mixture of a polyester resin as a "first" polymer and a polyvinyl acetal such as polyvinyl butyral or cellulose ester such as cellulose acetate butyrate as a "second" polymer."

In another embodiment, the buried backside conductive layer is disposed between a "first" layer and a "second" layer directly adhering to the support. In this embodiment, the first layer is directly above the backside conductive layer is known herein as a "first" layer, a "protective" layer, or a "protective topcoat" layer. It can be the outermost topcoat layer or have further layer(s) disposed thereon. This first layer comprises a film-forming polymer. The conductive layer immediately beneath the first layer comprises the non-acicular metal antimonate particles in a mixture of two or more polymers, a "first" polymer that serves to promote adhesion of the conductive layer to the second layer, and a "second" polymer that serves to promote adhesion of the conductive layer to the first layer.

It is preferred that the film-forming polymer of the first layer, and the "second" polymer of the backside conductive layer are the same or different polyvinyl acetal resins, polyester resins, cellulosic ester polymers, maleic anhydride-ester copolymers, or vinyl polymers. A preferred polymer is cellulose acetate butyrate.

It is preferred that the polymer of second, adhesion-promoting, layer and the "first" polymer of the backside conductive layer are the same or different polyester resins.

Representative "first" polymers can be chosen from one or more of the following classes: polyvinyl acetals (such as polyvinyl butyral, polyvinyl acetal, and polyvinyl formal), cellulosic ester polymers (such as cellulose acetate, cellulose diacetate, cellulose triacetate, cellulose acetate propionate, hydroxymethyl cellulose, cellulose nitrate, and cellulose acetate butyrate), polyesters, polycarbonates, epoxies, rosin polymers, polyketone resin, vinyl polymers (such as polyvinyl chloride, polyvinyl acetate, polystyrene, polyacrylonitrile, and butadiene-styrene copolymers), acrylate and methacrylate polymers, and maleic anhydride ester copolymers. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred. Polyester resins are most preferred. Thus, the adhesion-promoting polymers are generally hydrophobic in nature.

Representative "second" polymers include polyvinyl acetals, cellulosic polymers, vinyl polymers (as defined above for the "first" polymer), acrylate and methacrylate polymers, and maleic anhydride-ester copolymers. The most preferred "second" polymers are polyvinyl acetals and cellulosic ester polymers (such as cellulose acetate, cellulose diacetate, cellulose triacetate, cellulose acetate propionate, hydroxymethyl cellulose, cellulose nitrate, and cellulose acetate butyrate). Cellulose acetate butyrate is a particularly preferred second polymer. Of course, mixtures of these second polymers can be used in the backside conductive layer. These second polymers are also soluble or dispersible in the organic solvents described above.

It is preferred that the "first" and "second" polymers are compatible with each other or are of the same polymer class. One skilled in the art would readily understand from the teaching herein which polymers are "compatible with" or "of the same class" as those film-forming polymers. For example, it is most preferred to use a single phase mixture of a polyester resin as a "first" polymer and a cellulose ester such as cellulose acetate butyrate as a "second" polymer-."Many of the film-forming polymers useful in the first layer are described in other places herein (for example, binders used in imaging layers and or other conventional backside layers).

The backside conductive layers are generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents.

The backside conductive layers described herein can be coated by various coating procedures such as those described above for the thermographic and photothermographic imaging layers. Such procedures include wire wound rod coating, dip coating, air knife coating, curtain coating, slide coating, roll coating, reverse roll coating, gravure coating, or extrusion coating The weight ratio of "first" polymer to "second" polymer in the backside conductive layer is generally from about 10:90 to about 40:60 , and preferably from about 10:90 to about 30:70. A most preferred polymer combination is of polyester and cellulose acetate butyrate having a weight ratio of about 20:80.

The backside conductive layer can also include still other polymers that are not defined herein as first or second polymers. These additional polymers can be either hydrophobic or hydrophilic. Some hydrophilic polymers that may be present include, but are not limited to, proteins or polypeptides such as gelatin and gelatin derivatives, polysaccharides, gum arabic, dextrans, polyacrylamides (including polymethacrylamides), polyvinyl pyrrolidones and others that would be readily apparent to one skilled in the art.

The polymers in the backside conductive layer generally comprise at least 0.1 weight % (preferably at least 0.2 weight %) of the total wet coating weight of the layer. The maximum amount of such polymers is generally 40 weight %, and preferably up to 20 weight %, based on total wet coating weight.

As noted above, in preferred embodiments, the backside conductive layer is a relatively thin "buried" layer that provides desired benefits (that is, sensitometric and physical properties) beyond the necessary conductivity. Typically, the backside conductive layer has a dry thickness up to 2 $\mu$m and preferably up to 1 $\mu$m. The minimum dry thickness is generally at least 0.06 $\mu$m and preferably at least 0.15 $\mu$m. More preferably, the dry thickness is between 0.15 $\mu$m and0.50$\mu$m.

Other components of the backside conductive layer include materials that may improve coatability or adhesion, crosslinking agents (such as diisocyanates), surfactants and shelf-aging promoters.

The backside conductive layer may also include other addenda commonly added to such formulations including, but not limited to, shelf life extenders, antihalation dyes, colorants to control tint and tone, UV absorbing materials, to improve light-box stability, and coating aids such as surfactants to achieve high quality coatings, all in conventional amounts. It is also useful to add inorganic matting agents such as the polysilicic acid particles as described in U.S. Pat. No. 4,828,971 (Przezdziecki), poly(methyl methacrylate) beads as described in U.S. Pat. No. 5,310,640 (Markin et al.), or polymeric cores surrounded by a layer of colloidal inorganic particles as described in U.S. Pat. No. 5,750,328 (Melpolder et al.).

In one preferred embodiment, the "first" backside layer (usually referred to as a protective or topcoat layer) includes an antihalation composition, such as those antihalation compositions described above.

The thermally developable materials of this invention can also include one or more antistatic or conductive layers on the frontside of the support. Such layers may contain metal antimonates as described above, or other conventional antistatic agents known in the art for this purpose such as soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described above and in U.S. Pat. No. 5,368,995 (Christian et al.), electrically-conductive metal-containing particles dispersed in a polymeric binder such as those described in EP 0 678 776A1 (Melpolder et al.), and fluorochemicals that are described in numerous publications.

When particles are added to a coating layer, streaking can become a problem. Streaks can be caused by particles getting caught on the lips of a coating slot, causing flow instability, disturbing coating flow, and resulting in streaks. Streaks can also be formed by a denser liquid from an upper coating slot displacing a less dense liquid from a lower coating slot or even by flowing into an incompletely filled lower coating slot. In very thin layers formed from low-viscosity liquids, such as those used as carrier layers in slide coating, flow rates, and coating slot heights need to be adjusted carefully to prevent such penetration (see, for example, E. B. Gutoff and E. D. Cohen "*Coating and Drying Defects*," John Wiley & Sons, New York, 1995, p. 135).

The addition of metal antimonate particles to carrier layers used in slide coating procedures has been found to reduce streaking. The size of the metal antimonate particles appears to be too small to cause the flow instabilities seen with the larger particles normally used in coating. Moreover, the addition of metal antimonate particles to the carrier layer increases the density of the carrier layer without increasing its viscosity or otherwise reducing its usefulness as a carrier layer. Penetration of the denser upper layer into the coating slot of the lower layer is reduced or prevented by this increase in density. Penetration is most reduced when sufficient metal antimonate particles are present to increases the density of the lower layer so that it is equal to or greater then the density of the solution coated above it.

Imaging/Development

The thermally developable materials of the present invention can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm. In other embodiments, the materials are sensitive to radiation at 700 nm or greater (such as from about 750 to about 950 nm).

Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure,* September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

When imaging thermographic materials of this invention, the image may be "written" simultaneously with development at a suitable temperature using a thermal stylus, a thermal print head or a laser, or by heating while in contact with a heat-absorbing material. The thermographic materials may include a dye (such as an IR-absorbing dye) to facilitate direct development by exposure to laser radiation. The dye converts absorbed radiation to heat.

Use as a Photomask

The thermographic and photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials and subsequent development affords a visible image. The heat-developed thermographic and photothermographic materials absorbs ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

a) imagewise exposing the photothermographic material of this invention to electromagnetic radiation to which the photocatalyst (for example, a photosensitive silver halide) of the material is sensitive, to form a latent image, and b) simultaneously or sequentially, heating the exposed material to develop the latent image into a visible image.

The photothermographic material may be exposed in step A using any source of radiation, to which it is sensitive, including ultraviolet radiation, visible light, infrared radiation or any other infrared radiation source readily apparent to one skilled in the art.

The present invention also provides a method for the formation of a visible image (usually a black-and-white image) by thermal imaging of the inventive thermographic material. In one embodiment, the present invention provides a method comprising:

A) thermal imaging of the thermographic material of this invention to form a visible image.

This visible image prepared from either a thermographic or photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed thermographic or photothermographic material. Thus, in some other embodiments wherein the thermographic or photothermographic material comprises a transparent support, the image-forming method further comprises:

c) positioning the exposed and heat-developed thermographic or photothermographic material between a source of imaging radiation and an imageable material that is sensitive to the imaging radiation, and d) exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Experiments and Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID® A-21 is an acrylic copolymer available from Rohm and Haas (Philadelphia, Pa.).

ALBACAR 5970 is a 1.9 $\mu$m precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15S and CAB 381-20 are cellulose acetate butyrate resins available from Eastman Chemical Co. (Kingsport, Tenn.).

CELNAX® CX-Z401M is a 40% organosol dispersion of non-acicular zinc antimonate particles in methanol. It was obtained from Nissan Chemical America Corporation (Houston, Tex.).

L-9342 is a perfluorinated organic antistatic agent described as Compound 1 of U.S. Pat. No. 4,975,363 (Cavallo et al.). It was obtained from 3M Company (St. Paul, Minn.).

MEK is methyl ethyl ketone (or 2-butanone).

PERMANAX WSO (or NONOX®) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

PIOLOFORM® BL-16 and PIOLOFORM® BN-18 are polyvinyl butyral resins available from Wacker Polymer Systems (Adrian, Mich.).

SYLOID® 74X6000 is a synthetic amorphous silica that is available from Grace-Davison (Columbia, Md.).

VITEL® PE-2700B LMW is a polyester resin available from Bostik, Inc. (Middleton, Mass.).

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

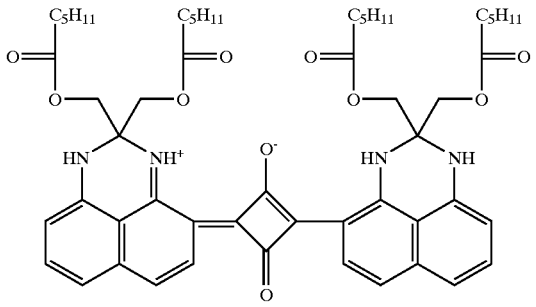

Ethyl-2-cyano-3-oxobutanoate has the structure shown below.

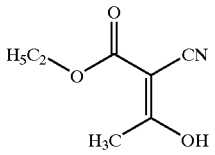

Vinyl Sulfone-1 (VS-1) is described in U.S. Pat. No. 6,143,487 and has the following structure:

VS-1

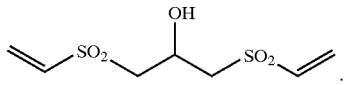

Resistivity Measurements:

Resistivity of antistatic coatings was measured using three different methods, the "decay time" test, the "surface resistivity" test, and the "wet electrode resistivity" test.

In the decay "time test," an ETS Model 406D Static Decay Meter (Electro-Tech Systems Inc., Glenside, Pa.) was used to determine the rate of static charge decay on a sample. The sample is subjected to a fixed voltage to induce an electrostatic charge on its surface. The charge is then dissipated (bled off) by providing a path for current flow to ground. The time for the charge to dissipate to certain pre-selected levels (10% in our test) is recorded.

Decay times were measured in a room maintained at 70° F. (21.1° C.) and 20% relative humidity (RH) unless otherwise specified. All testing was done in this room after samples had been acclimated for 18 to 24 hours. A +5 kV charge was applied and the time to reach 10% of the charge (90% decay) was recorded. Samples that demonstrate poor antistatic properties do not dissipate charge and their decay times are reported as "not conductive."In order to function as an antistatic material, a compound should provide a coating having a decay time of less than 25 seconds and preferably less than 5 seconds at a temperature of 70° F. (21.1° C.) and a relative humidity of 20%. Decay times less than 1 second are preferred.

In the "surface resistivity" (SER) test, three Keithley instruments, a Model 247 High Voltage Supply, a Model 480 Digital Picometer, and a Model 6105 Resistivity Adapter (Keithley Instruments Inc., Cleveland Ohio) were used.

Surface resistivity was again measured in a room maintained at 70° F. (21.1° C.)/20% relative humidity (RH) and all testing was done in this room. A potential of 500 volts was applied to the sample and the current going through the sample was measured. The conversion from amperes (current) to ohm/sq (resistivity) was calculated using the following equation (provided by Kiethley):

$$\text{Ohm/sq}=26{,}700/\text{amperes}$$

The Kiethley Device cannot measure current below $1\times10^{-12}$ amperes. Thus resistivity greater than $2.67\times10^{16}$ ohm/sq cannot be calculated. Films having a resistivity calculated greater than $2.67\times10^{16}$ ohm/sq are reported below as $>2.67\times10^{16}$ ohm/sq. In order to function as an antistatic material, a compound should provide a coating having a resistivity of less than $1\times10^{14}$ ohm/sq, preferably less than $1\times10^{12}$ ohm/sq, and more preferably less than $10^{11}$ ohm/sq at a temperature of 70° F. (21.1° C.) and a relative humidity of 20%.

In the "wet electrode resistivity" (WER) test, antistatic performance was evaluated by measuring the internal resistivity of the overcoated electrically-conductive antistatic layer using a salt bridge wet electrode resistivity measurement technique. This technique is described in R. A. Elder "Resistivity Measurements on Buried Conductive Layers," EOS/ESD Symposium Proceedings, Lake Buena Vista, Fla., 1990, pp. 251–254, incorporated herein by reference. [EOS/ESD stands for Electrical Overstress/Electrostatic Discharge]. Typically, antistatic layers with WER values greater than about $1\times10^{12}$ ohm/square are considered to be ineffective at providing static protection for photographic imaging elements. We have also found WER measurements to be more predictive of how an antistatic material will perform when used in a commercial product.

Sensitometry Measurements:

Densitometry measurements were made on a custom built computer-scanned densitometer and meeting ISO Standards 5-2 and 5-3 and are believed to be comparable to measurements from commercially available densitometers. $D_{min}$ is the density of the non-exposed areas after development and it is the average of the eight lowest density values.

EXAMPLE 1

Photothermographic Materials with Improved Aging Characteristics

When a thermally developable material is stored before use, it should remain static free. Because it is not uncommon for a thermally developed film to be looked at many years after imaging it should remain static free even after prolonged storage.

Buried Backside Conductive Layer Formulation:

A buried backside conductive layer formulation was prepared by mixing the following materials:

| | |
|---|---|
| CELNAX ® CX-Z401M (containing 40% active solids) | 50.0 parts |
| MEK | 375 parts |
| VITEL ® PE-2700B LMW | 4.39 parts |
| CAB 381-20 | 17.5 parts |

Backside Topcoat Formulation:

A backside topcoat formulation was prepared by mixing the following materials:

| | |
|---|---|
| MEK | 87.2 parts |
| CAB 381-20 | 11.0 parts |

-continued

| | |
|---|---|
| SYLOID ® 74X6000 | 0.14 parts |
| Antihalation Dye BC-1 | 0.06 parts |

The buried backside conductive layer formulation and backside topcoat formulations were coated onto one side of a 7 mil (178 $\mu$m) blue tinted poly(ethylene terephthalate) support. A precision multilayer coater equipped with an in-line dryer was used. The coating weight of the backside conductive layer was 0.05 g/ft$^2$ (0.54 g/m$^2$) and that of the backside topcoat layer was 0.4 g/ft$^2$ (4.3 g/m$^2$).

Comparison Buried Backside Non-Conductive Layer Formulation:

A buried backside non-conductive layer formulation was prepared by mixing the following materials:

| | |
|---|---|
| MEK | 94.5 parts |
| CAB 381-20 | 4.4 parts |
| VITEL ® PE-2700B LMW | 1.1 parts |
| Antihalation Dye BC-1 | 0.50 parts |

Comparison Topcoat Conductive Layer Formulation:

A comparison topcoat backside conductive layer formulation similar to that described in U.S. Pat. No. 6,171,707 (Gomez et al.) was prepared by mixing the following materials:

| | |
|---|---|
| MEK | 87.72 parts |
| CAB 381-20 | 10.98 parts |
| SYLOID ® 74X6000 | 0.14 parts |
| L-9342 (containing 75% active solids) | 1.16 parts. |

These formulations were coated as described above. The coating weight of the buried backside non-conductive layer was 0.025 g/ft$^2$ (0.0.27 g/m$^2$) and that of the backside conductive topcoat layer was 0.4 g/ft$^2$ (4.3 g/m$^2$).

Photothermographic emulsion and topcoat formulations were prepared as follows:

Photothermographic Emulsion Formulation:

A photothermographic emulsion coating formulation was prepared using a silver salt homogenate prepared substantially as described in Col. 25 of U.S. Pat. No. 5,434,043 (noted above), incorporated herein by reference. The emulsion formulation was then prepared substantially as described in Cols. 19–24 of U.S. Pat. No. 5,541,054 (Miller et al.), also incorporated herein by reference.

Photothermographic Emulsion Topcoat Formulation:

A topcoat formulation was prepared for application over the photothermographic emulsion formulation with the following components:

| | |
|---|---|
| MEK | 86.10 weight % |
| Vinyl sulfone | 0.35 weight % |
| Benzotriazole | 0.27 weight % |
| Silica | 0.21 weight % |
| ACRYLOID ® A-21 | 0.47 weight % |
| CAB 171-15S | 12.25 weight % |
| Antihalation dye BC-1 | 0.21 weight % |
| Ethyl-2-cyano-3-oxobutanoate | 0.23 weight % |

Photothermographic Emulsion Carrier Layer Formulation:

A "carrier" layer formulation for the photothermographic emulsion and topcoat layers was prepared as described in U.S. Pat. No. 6,355,405 (Ludemann et al.).

The photothermographic emulsion, topcoat, and carrier layer formulations were coated onto the side of the support opposite to that containing the antistatic coating using a precision multilayer coater equipped with an in-line dryer was used. The materials were cut into 14×17 inch (35.6 cm×43.2 cm) sheets, stacked, and aged under the conditions described below in TABLES I and II.

The evaluation of conductive properties of the antistatic coatings after storage at 70° F. (21.1° C.) at various percent relative humidity (RH) were carried out. This is often referred to as "natural age keeping." The materials prepared as described above were stored for various times at various humidity conditions. Their surface resistivity, decay time, and wet electrode resistivity were then measured. The results, shown below in TABLES I and II, demonstrate that the photothermographic materials of this invention (Examples 1-1 to 1-4) do not lose their antistatic properties over time. The results also demonstrate that the materials of this invention have improved antistatic properties when compared to a comparative photothermographic material containing L-9342 (Examples C-1-5 to C-1-8).

TABLE I

| | | | SER Resistivity (Ohms/sq) | | |
|---|---|---|---|---|---|
| Example | Antistatic Agent | Days of Keeping | 70° F. (21.1° C.) 20% RH | 70° F. (21.1° C.) 50% RH | 70° F. (21.1° C.) 80% RH |
| 1-1 | CELNAX ® CX-Z401M | 0 | $3.45 \times 10^{12}$ | $3.45 \times 10^{12}$ | $3.45 \times 10^{12}$ |
| 1-2 | CELNAX ® CX-Z401M | 42 | $1.70 \times 10^{12}$ | $4.50 \times 10^{11}$ | $1.06 \times 10^{11}$ |
| 1-3 | CELNAX ® CX-Z401M | 72 | $2.30 \times 10^{12}$ | $4.10 \times 10^{11}$ | $1.04 \times 10^{11}$ |
| 1-4 | CELNAX ® CX-Z401M | 102 | $3.00 \times 10^{12}$ | $2.90 \times 10^{11}$ | $1.01 \times 10^{11}$ |
| C-1-5 | L-9342 | 0 | $5.90 \times 10^{12}$ | $5.90 \times 10^{12}$ | $5.97 \times 10^{12}$ |
| C-1-6 | L-9342 | 42 | $1.02 \times 10^{13}$ | $2.00 \times 10^{12}$ | $2.19 \times 10^{11}$ |
| C-1-7 | L-9342 | 72 | $1.30 \times 10^{13}$ | $3.40 \times 10^{12}$ | $6.29 \times 10^{11}$ |
| C-1-8 | L-9342 | 107 | $1.80 \times 10^{14}$ | $6.70 \times 10^{12}$ | $1.59 \times 10^{12}$ |

TABLE II

| | | | Decay Time (Seconds) | | |
|---|---|---|---|---|---|
| Example | Antistatic Agent | Days of Keeping | 70° F. (21.1° C.) 20% RH | 70° F. (21.1° C.) 50% RH | 70° F. (21.1° C.) 80% RH |
| 1-1 | CELNAX ® CX-Z401M | 0 | 0.02 | 0.01 | 0.02 |
| 1-2 | CELNAX ® CX-Z401M | 42 | 0.02 | 0.01 | 0.02 |
| 1-3 | CELNAX ® CX-Z401M | 72 | 0.02 | 0.02 | 0.02 |
| 1-4 | CELNAX ® CX-Z401M | 102 | 0.02 | 0.02 | 0.02 |
| C-1-5 | L-9342 | 0 | 2.80 | 2.72 | 2.72 |
| C-1-6 | L-9342 | 42 | 5.28 | 1.52 | 0.15 |
| C-1-7 | L-9342 | 72 | 10.86 | 3.55 | 0.61 |
| C-1-8 | L-9342 | 107 | 28.28 | 9.50 | 0.28 |

Example 2

Photothermographic Materials and Aging Characteristics

Evaluation of antistatic coatings after storage at 120° F. (48.8° C.) and 50% RH (relative humidity) has been found to be predictive of how well an antistatic coating will retain its antistatic properties over a long period of time and is often referred to as "accelerated aging" or "stressed aging."

Photothermographic materials prepared as described in Example 1 were stored in a black polyethylene bag at 120° F. (48.8° C.) and 50% RH. Periodically, samples were removed and allowed to acclimate at 70° F. (21.1° C.) and 20% RH for 18 to 24 hours. Surface resistivity and decay times were then measured.

The results, shown below in TABLE III, demonstrate that the photothermographic materials of the present invention (Examples 1-1 to 1 -11) had acceptable surface resistivity after accelerated aging. Comparative Examples C-1-12 to C-1-22, containing L-9342 did not perform as well.

TABLE III

| Example | Antistatic Agent | Days of Keeping | Decay Time (Seconds) | SER Resistivity (Ohms/sq) |
|---|---|---|---|---|
| 2-1 | CELNAX ® CX-Z401M | 0 days | 0.02 | $3.5 \times 10^{12}$ |
| 2-2 | CELNAX ® CX-Z401M | 5 days | 0.02 | $1.2 \times 10^{12}$ |
| 2-3 | CELNAX ® CX-Z401M | 8 days | 0.02 | $3.3 \times 10^{12}$ |
| 2-4 | CELNAX ® CX-Z401M | 11 days | 0.02 | $2.5 \times 10^{12}$ |
| 2-5 | CELNAX ® CX-Z401M | 14 days | 0.02 | $2.3 \times 10^{12}$ |
| 2-6 | CELNAX ® CX-Z401M | 19 days | 0.02 | $2.3 \times 10^{12}$ |
| 2-7 | CELNAX ® CX-Z401M | 22 days | 0.02 | $1.5 \times 10^{12}$ |
| 2-8 | CELNAX ® CX-Z401M | 25 days | 0.02 | $1.9 \times 10^{12}$ |
| 2-9 | CELNAX ® CX-Z401M | 29 days | 0.02 | $1.9 \times 10^{12}$ |
| 2-10 | CELNAX ® CX-Z401M | 41 days | 0.02 | $2.1 \times 10^{12}$ |
| 2-11 | CELNAX ® CX-Z401M | 96 days | 0.02 | $2.1 \times 10^{12}$ |
| C-2-12 | L-9342 | 0 days | 4.50 | $5.9 \times 10^{12}$ |
| C-2-13 | L-9342 | 5 days | 18.57 | $2.5 \times 10^{13}$ |
| C-2-14 | L-9342 | 8 days | 36.01 | $8.5 \times 10^{13}$ |
| C-2-15 | L-9342 | 11 days | 36.91 | $7.8 \times 10^{13}$ |
| C-2-16 | L-9342 | 14 days | 59.35 | $1.1 \times 10^{14}$ |
| C-2-17 | L-9342 | 19 days | 58.02 | $1.2 \times 10^{14}$ |
| C-2-18 | L-9342 | 22 days | 72.66 | $1.3 \times 10^{14}$ |
| C-2-19 | L-9342 | 25 days | 110.74 | $1.7 \times 10^{14}$ |
| C-2-20 | L-9342 | 29 days | 92.20 | $2.2 \times 10^{14}$ |
| C-2-21 | L-9342 | 41 days | 89.82 | $1.5 \times 10^{14}$ |
| C-2-22 | L-9342 | 96 days | 106.61 | $1.6 \times 10^{14}$ |

EXAMPLE 3

Photothermographic Materials with Improved Resistivity and Lower $D_{min}$

A problem often encountered in using metal particles as conductive layers in thermally developable materials is an increase in $D_{min}$ due to the color of the metal particles. Use of metal antimonate particles in buried layers has been found to reduce this problem.

Coatings were prepared incorporating CELNAX® CX-Z401 M in a buried conductive layer. An antihalation dye was used in a backside topcoat layer. These samples are labeled below as Examples 3-1 to 3-5 and were prepared in the following manner.

Buried Backside Conductive Layer Formulation:

A buried backside conductive layer formulation was prepared by mixing the following materials to provide a solution with a resin/metal antimonate ratio of 1.095:1.

| | |
|---|---|
| CELNAX ® CX-Z401M (containing 40% active solids) | 50 parts |
| MEK | 375 parts |
| VITEL ® PE-2700B LMW | 4.39 parts |
| CAB 381-20 | 17.5 parts |

Backside Topcoat Formulation:

A backside topcoat formulation was prepared by mixing the following materials:

| | |
|---|---|
| MEK | 87.2 parts |
| CAB 381-20 | 11.0 parts |
| SYLOID ® 74X6000 | 0.14 parts |
| Antihalation Dye BC-1 | 0.06 parts |

The buried backside conductive layer formulation and backside topcoat formulations were coated onto one side of a 7 mil (178 $\mu$m) blue tinted poly(ethylene terephthalate) support. A precision multilayer coater equipped with an in-line dryer was used. The coating weight of the buried backside conductive layer was varied to provide samples with different coating weights of buried backside conductive layer and backside topcoat layers. These coating weights are shown in TABLE IV.

A comparative coating was also prepared using L-9342 in a backside overcoat layer. This sample is labeled below as Example C-3-6 and was prepared in the following manner.

Buried Backside Non-Conductive Layer Formulation:

A buried backside non-conductive layer formulation was prepared by mixing the following materials:

| | |
|---|---|
| MEK | 94.5 parts |
| CAB 381-20 | 4.4 parts |
| VITEL ® PE-2700B LMW | 1.1 parts |
| Antihalation Dye BC-1 | 0.50 parts |

Backside Topcoat Formulation:

A backside topcoat formulation was prepared by mixing the following materials:

| | |
|---|---|
| MEK | 87.72 parts |
| CAB 381-20 | 10.98 parts |
| SYLOID ® 74X6000 | 0.14 parts |
| L-9342 at 75% solids (containing 75% active solids) | 1.16 parts. |

The buried backside non-conductive layer formulation and backside topcoat formulations were coated onto one side of a 7 mil (178 $\mu$m) blue tinted poly(ethylene terephthalate) support. A precision multilayer coater equipped with an in-line dryer was used. The coating weight of the backside non-conductive layer was 0.025 g/ft$^2$ (0.0.27 g/m$^2$ ) and that of the backside conductive topcoat layer was 0.4 g/ft$^2$ (4.3 g/m$^2$).

A comparative coating was also prepared using CELNAX® CX-Z401M in a backside overcoat layer. This sample is labeled Example C-3-7 and was prepared in the following manner.

Buried Backside Non-Conductive Layer Formulation:

A buried backside non-conductive layer formulation was prepared by mixing the following materials to provide a solution with a resin/metal antimonate ratio of 1.098:1.

| | |
|---|---|
| MEK | 94.5 parts |
| VITEL ® PE-2700B LMW | 1.1 parts |
| CAB 381-20 | 4.4 parts |

-continued

| | |
|---|---|
| Antihalation Dye BC-1 | 0.50 parts |

Backside Topcoat Formulation:

A backside topcoat formulation was prepared by mixing the following materials:

| | |
|---|---|
| MEK | 62.68 parts |
| CAB 381-20 | 10.98 parts |
| SYLOID ® 74X6000 | 0.14 parts |
| CELNAX ® CX-Z401M (containing 40% active solids) | 25.00 parts |

The buried backside non-conductive layer formulation and backside topcoat formulations were coated onto one side of a 7 mil (178 $\mu$m) blue tinted poly(ethylene terephthalate) support. A precision multilayer coater equipped with an in-line dryer was used. The coating weight of the backside non-conductive layer was 0.025 g/ft$^2$ (0.27 g/m$^2$) and that of the backside conductive topcoat layer was 0.4 g/ft$^2$ (4.3 g/m$^2$).

A photothermographic formulation prepared as described in Example 1 above was coated onto the side of the support opposite to that containing the conductive layer using a precision multilayer coater equipped with an in-line dryer.

The results, shown below in TABLE IV demonstrate that the use of metal antimonate particles in the buried layer provide photothermographic retaining excellent resistivity while having lower $D_{min}$ than the other types of conductive coatings. The results also demonstrate that the amount of metal antimonate particles in the buried conductive layer can be adjusted to provide the desired resistivity. Example 3-3 provides the best balance of resistivity and coating weight.

Examples 3-1 to 3-5 all had excellent adhesion, to the support, and excellent coating quality. They also displayed no static properties when used under simulated use such as being placed onto and removed from a light-box or being placed into and removed from a storage envelope.

Example 3-3 also displayed no static related problems when sheets were imaged and transported through an apparatus used to image photothermographic materials.

TABLE IV

| | | | SER Resistivity (ohms/sq) | | WER Resistivity (ohms/sq) | |
|---|---|---|---|---|---|---|
| Example | Coating Weight (g/m$^2$) | $D_{min}$ | 70° F. (21.1° C.) 20% RH | 70° F. (21.1° C.) 50% RH | 70° F. (21.1° C.) 15% RH | 70° F. (21.1° C.) 50% RH |
| 3-1 | Buried Layer = 0.43 Wt. of Antistat = 0.21 | | $1 \times 10^{13}$ | Not Measured | $6.3 \times 10^{11}$ | $2.3 \times 10^{11}$ |
| 3-2 | Buried Layer = 0.48 Wt. of Antistat = 0.23 | | $6 \times 10^{12}$ | Not Measured | $2.5 \times 10^{10}$ | $1.8 \times 10^{10}$ |
| 3-3 | Buried Layer = 0.54 Wt. of Antistat = 0.26 | 0.208 | $3 \times 10^{12}$ | $8 \times 10^{11}$ | $4 \times 10^{9}$ | $6 \times 10^{9}$ |
| 3-4 | Buried Layer = 0.59 Wt. of Antistat = 0.28 | | $3 \times 10^{12}$ | Not Measured | $5 \times 10^{09}$ | $7.9 \times 10^{9}$ |
| 3-5 | Buried Layer = 0.65 Wt. of Antistat = 0.31 | | $3 \times 10^{12}$ | Not Measured | $2 \times 10^{9}$ | $3.5 \times 10^{9}$ |
| C-3-6 | Backcoat Layer = 4.3. Wt. of Antistat = 0.33 | 0.217 | $8 \times 10^{12}$ | $1 \times 10^{12}$ | $3 \times 10^{11}$ | $3 \times 10^{11}$ |
| C-3-7 | Backcoat Layer = 4.3. Wt. of Antistat = 2.02 | 0.238 | Not Measured | $3.9 \times 10^{9}$ | Not Measured | Not Measured |

EXAMPLE 4

Thermographic Materials with Improved Aging Characteristics

The following example demonstrates the use of the antistatic materials of the invention in a thermographic material.

Silver Soap Homogenate Formulation:

A silver soap thermographic homogenate formulation was prepared with the following components.

| | |
|---|---|
| MEK | 75.5% |
| Silver Behenate | 24.0% |
| PIOLOFORM ® BL-16 | 0.5% |

The materials were mixed and homogenized by passing twice through a homogenizer at 5000 psi (352 kg/cm$^2$). The materials were cooled between the two passes.

Thermographic Emulsion Formulation:

To 24.74 g of this silver behenate homogenate at 24.5% solids was added 2.77 g of MEK, 0.96 g of phthalazinone, 1.71 g of 2,3-dihydroxybenzoic acid, and a solution of 20.9 g of BUTVAR® B-79 in 48.9 g of MEK. The reaction was stirred for 10 minutes to dissolve the materials.

Thermographic Layer Topcoat Formulation:

A topcoat formulation was prepared for application over the thermographic emulsion formulation with the following components:

| | |
|---|---|
| MEK | 44.8 parts |
| CAB 171-15S | 51.10 parts |
| PARALOID A-21 | 1.36 parts |
| DC 550 | 1.65 parts |
| SERVOXYL ® VPAZ 100 | 0.22 parts |
| ALBACAR 5970 | 0.15 parts |

The resulting topcoat solution contained 13.9% solids and had a viscosity of 90 centipoise.

The thermographic emulsion and topcoat formulations were coated onto a 7 mil (178 $\mu$m) blue tinted polyethylene terephthalate support using a conventional, laboratory scale, automated dual knife coating machine. Samples were dried in an oven at 200° F. (93.3° C.) for 3.5 minutes. The coating weight of the thermographic emulsion layer was 2.0 g/ft$^2$ (21.5 g/m$^2$). The coating weight of the topcoat layer was 0.4 g/ft$^2$ (4.3 g/m$^2$).

Buried Backside Conductive Layer Formulation:

A buried backside conductive layer formulation was prepared by mixing the following materials:

| | |
|---|---|
| CELNAX ® CX-Z401M (containing 40% active solids) | 12.53 parts |
| MEK | 81.97 parts |
| CAB 381-20 | 4.40 parts |
| VITEL ® PE-2700B LMW | 1.10 parts |

Backside Topcoat Formulation:

A backside topcoat formulation was prepared by mixing the following materials:

| | |
|---|---|
| MEK | 87.72 parts |
| CAB 381-20 | 10.98 parts |
| SYLOID ® 74X6000 | 0.14 parts |

The buried backside conductive layer formulation and backside topcoat formulations were simultaneously coated onto the side of the support opposite to that containing the thermographic coating using a automated dual knife coater. The coatings were dried at 95° C. for 3.5 minutes to afford a thermographic material. The dry coating weight of the backside conductive layer was 0.05 g/ft$^2$ (0.54 g/m2 ) and that of the backside topcoat layer was 0.4 g/ft2 (4.3 g/m2). The weight ratio of binder to particles in the buried conductive layer was 1.097:1.

Evaluation of antistatic coatings after storage at 120° F. (48.8° C.) and 50% RH (relative humidity) has been found to be predictive of how well an antistatic coating will retain its antistatic properties over a long period of time and is often referred to as "accelerated aging" or "stressed aging."

Samples of the thermographic materials were stored in a black polyethylene bag at 120° F. (48.8° C.) and 50% RH. Periodically, samples were removed and allowed to acclimate at 70° F. (21.1° C.) and 20% RH for 18 to 24 hours. Surface resistivity and decay times were then measured.

The results, shown below in TABLE V, demonstrate that the nonimaged thermographic materials of the present invention retain their excellent surface resistivity.

TABLE V

| Example | Antistatic Agent | Days of Keeping | Decay Time (Seconds) | SER Resistivity (Ohms/sq) |
|---|---|---|---|---|
| 4-1 | CELNAX ® CX-Z401M | 0 | 0.01 | $3.2 \times 10^{10}$ |
| 4-1 | CELNAX ® CX-Z401M | 14 | 0.01 | $3.7 \times 10^{10}$ |

The invention has been described in detail with particular reference to certain preferred embodiments thereof, but it will be understood that variations and modifications can be effected within the spirit and scope of the invention.

We claim:

1. A thermally developable material that comprises a support having on one side thereof, one or more thermally developable imaging layers comprising a binder and in reactive association, a non-photosensitive source of reducible silver ions, and a reducing agent composition for said non-photosensitive source reducible silver ions, and having disposed on the backside of said support:

a) a first layer comprising a film-forming polymer, and b) interposed between said support and said first layer and directly adhering said first layer to said support, a non-imaging backside conductive layer comprising non-acicular metal antimonate particles in a mixture of two or more polymers that include a first polymer serving to promote adhesion of said conductive layer directly to said support, and a second polymer that is different than and forms a single phase mixture with said first polymer, wherein said film-forming polymer of said first layer and said second polymer of said conductive layer are the same or different polyvinyl acetal resins, polyester resins, cellulosic polymers, maleic anhydride-ester copolymers, or vinyl polymers.

2. The thermally developable material of claim 1 wherein said film-forming polymer of said first layer and said second polymer of said conductive layer are the same or different polyvinyl acetal resin or cellulosic ester polymer.

3. The thermally developable material of claim 2 wherein said film-forming polymer of said first layer and second polymer of said conductive layer are both polyvinyl butyral, or cellulose acetate butyrate.

4. The thermally developable material of claim 1 wherein said first polymer is a polyvinyl acetal, cellulosic ester polymer, polyvinyl chloride, polyvinyl acetate, epoxy resin, polyester resin, polystyrene, polyacrylonitrile, polycarbonate, acrylate or methacrylate polymer, maleic anhydride ester copolymer, and butadiene-styrene polymer.

5. The thermally developable material of claim 4 wherein said first polymer is a polyester resin.

6. The thermally developable material of claim 1 wherein said backside conductive layer comprises a single-phase mixture of a polyester resin with either polyvinyl butyral or cellulose acetate butyrate.

7. The thermally developable material of claim 1 wherein said backside conductive layer has a dry thickness of from about 0.06 to about 2 $\mu$m, and the weight ratio of said first polymer to said second polymer in said backside conductive layer is from about 10:90 to about 40:60.

8. The thermally developable material of claim 1 wherein said non-acicular metal antimonate particles comprise from about 40 to about 55% by weight of said backside conductive layer.

9. The thermally developable material of claim 1 wherein said non-acicular metal antimonate particles are present in said backside conductive layer in an amount of from about 0.05 to about 2 g/m$^2$.

10. The thermally developable material of claim 1 wherein said non-acicular metal antimonate particles are present in an amount sufficient to provide a backside resistivity measured at 21.1° C. and 20% relative humidity of $4\times10^{12}$ ohms/sq or less.

11. The thermally developable material of claim 1 wherein said non-acicular metal antimonate particles having a composition represented by the following Structure I or II:

$$M^{+2}Sb^{+5}{}_2O_6 \quad (I)$$

wherein M is zinc, nickel, magnesium, iron, copper, manganese, or cobalt, $$M_a{}^{+3}Sb^{+5}O_4 \quad (II)$$

wherein $M_a$ is indium, aluminum, scandium, chromium, iron, or gallium.

12. The thermally developable material of claim 1 wherein said non-acicular metal antimonate particles are composed of $ZnSb_2O_6$.

13. The thermally developable material of claim 1 wherein said non-photosensitive source of reducible silver ions is a silver salt of an aliphatic carboxylate or a mixture of silver salts of aliphatic carboxylates, at least one of which is silver behenate.

14. The thermally developable material of claim 1 that further comprises a photosensitive silver halide and is a photothermographic material.

15. A photothermographic material that comprises a support having on one side thereof, one or more thermally developable imaging layers comprising a binder and in reactive association, a photosensitive silver halide, a non-photosensitive source of reducible silver ions, and a reducing agent composition for said non-photosensitive source reducible silver ions, and having disposed on the backside of said support:

a) a first layer comprising a film-forming polymer, and b) interposed between said support and said first layer and directly adhering said first layer to said support, a non-imaging backside conductive layer comprising non-acicular metal antimonate particles in a mixture of two or more polymers that include a first polymer serving to promote adhesion of said backside conductive layer directly to said support, and a second polymer that is different than and forms a single phase mixture with said first polymer, wherein said film-forming polymer of said first layer and said second polymer of said backside conductive layer are the same or different polyvinyl acetal resins, polyester resins, cellulosic polymers, maleic anhydride-ester copolymers, or vinyl polymers.

16. The photothermographic material of claim 15 wherein said photosensitive silver halide is a preformed silver halide or mixture of preformed silver halides.

17. The photothermographic material of claim 15 wherein said photosensitive silver halide is provided as tabular or cubic silver bromide or silver iodobromide grains, or a mixture of any of these silver halide grains.

18. The photothermographic material of claim 15 wherein said first layer comprises an antihalation composition.

19. A black-and-white photothermographic material that comprises a transparent polymeric support having on one side thereof one or more thermally developable imaging layers comprising predominantly one or more hydrophobic binders including at least polyvinyl butyral, and in reactive association, a preformed photosensitive silver bromide or silver iodobromide present as tabular and/or cubic grains, a non-photosensitive source of reducible silver ions that includes one or more silver aliphatic carboxylates at least one of which is silver behenate, a reducing agent composition for said non-photosensitive source reducible silver ions comprising a hindered phenol or mixture thereof, and a protective layer disposed over said one or more thermally developable imaging layers, and having disposed on the backside of said support:

a) a backside protective layer comprising a film-forming polymer that is cellulose acetate butyrate, and b) interposed between said support and said backside protective layer and directly adhering said backside protective layer to said support, a non-imaging backside conductive layer comprising non-acicular metal antimonate particles in a mixture of two or more polymers that include a first polymer serving to promote adhesion of said conductive layer directly to said support, and a second polymer that is different than and forms a single phase mixture with said first polymer, wherein said first polymer of said backside conductive layer is a polyester and said second polymer of said backside conductive layer is cellulose acetate butyrate, and said non-acicular metal antimonate particles are composed of $ZnSb_2O_6$ and comprise from about 40 to about 55% by weight of the backside conductive layer in an amount of from about 0.05 to about 2 g/m$^2$.

20. The photothermographic material of claim 15 having an optical density of from about 0.2 to about 3 on the imaging layer side of said support or an optical density of up to 2 on the backside of said support.

21. A black-and-white thermographic material that comprises a transparent polymeric support having on one side thereof one or more thermally developable imaging layers comprising predominantly one or more hydrophobic binders including at least polyvinyl butyral, and in reactive association, a non-photosensitive source of reducible silver ions that includes one or more silver aliphatic carboxylates at least one of which is silver behenate, a reducing agent composition for said non-photosensitive source reducible silver ions comprising an aromatic di- and tri-hydroxy compound having at least two hydroxy groups in ortho- or para-relationship on the same aromatic nucleus or mixture thereof, and a protective layer disposed over said one or more thermally developable imaging layers, and having disposed on the backside of said support:

a) a backside protective layer comprising a film-forming polymer that is cellulosic acetate butyrate, and b) interposed between said support and said backside protective layer and directly adhering said backside protective layer to said support, a non-imaging backside conductive layer comprising non-acicular metal antimonate particles in a mixture of two or more polymers that include a first polymer serving to promote adhesion of said backside conductive layer directly to said support, and a second polymer that is different than and forms a single phase mixture with said first polymer, wherein said first polymer of said backside conductive layer is a polyester and said second polymer of said backside conductive layer is cellulosic acetate butyrate, and said non-acicular metal antimonate particles are composed of $ZnSb_2O_6$ and comprise from about 40 to about 55% by weight of the backside conductive layer and are present in the conductive layer in an amount of from about 0.05 to about 2 $g/m^2$.

22. A method of forming a visible image comprising:

a) imagewise exposing the photothermographic material of claim 15 to electromagnetic radiation to form a latent image, b) simultaneously or sequentially, heating said exposed photothermographic material to develop said latent image into a visible image.

23. The method of claim 22 wherein said photothermographic material comprises a transparent support and said image-forming method further comprises:

c) positioning said exposed and heat-developed photothermographic material with the visible image thereon between a source of imaging radiation and an imageable material that is sensitive to said imaging radiation, and d) thereafter exposing said imageable material to said imaging radiation through the visible image in said exposed and heat-developed photothermographic material to provide an image in said imageable material.

24. The method of claim 22 wherein said photothermographic material is imaged at an exposure wavelength greater than 700 nm.

25. A method of forming a visible image comprising thermal imaging of the thermally developable material of claim 1 that is a thermographic material.

26. A thermally developable material that comprises a support having on one side thereof, one or more thermally developable imaging layers comprising a binder and in reactive association, a non-photosensitive source of reducible silver ions, and a reducing agent composition for said non-photosensitive source reducible silver ions, and having disposed on the backside of said support:

a) a first layer comprising a film-forming polymer, b) a second layer directly adhered to said support, comprising a mixture of two or more polymers that includes a first polymer serving to promote adhesion of said second layer directly to said support, and a second polymer that is different than and forms a single phase mixture with said first polymer, and c) interposed between said first layer and said second layer, a non-imaging backside conductive layer comprising non-acicular metal antimonate particles in a polymer serving to promote adhesion of said backside conductive layer directly to said first and second layers, wherein said film-forming polymer of said first layer, said polymer of said conductive layer, and said second polymer of said second layer are the same or different polyvinyl acetal resins, polyester resins, cellulosic polymers, maleic anhydride-ester copolymers, or vinyl polymers.

27. The thermally developable material of claim 26 wherein said film-forming polymer of said first layer, said polymer of said backside conductive layer, and said second polymer of said second layer are both cellulose acetate butyrate, and said first polymer of said second layer is a polyester.

28. A thermally developable material that comprises a support having on one side thereof, one or more thermally developable imaging layers comprising a binder and in reactive association, a non-photosensitive source of reducible silver ions, and a reducing agent composition for said non-photosensitive source reducible silver ions, and having disposed on the backside of said support:

a) a first layer comprising a film-forming polymer, b) a second layer directly adhered to said support, comprising a first polymer, and c) interposed between said first layer and said second layer, a non-imaging backside conductive layer comprising non-acicular metal antimonate particles in a mixture of two or more polymers that includes a first polymer that serves to promote adhesion to said second layer, and a second polymer that is different than and forms a single phase mixture with said first polymer, and serves to promote adhesion to said first layer, wherein said film-forming polymer of said first layer and one of said two or more polymers of said backside conductive layer are the same or different polyvinyl acetal resins, polyester resins, cellulosic polymers, maleic anhydride-ester copolymers, or vinyl polymers.

29. The thermally developable material of claim 28 wherein said film-forming polymer of said first layer, said second polymer of said conductive layer are both cellulose acetate butyrate, and said first polymer of said backside conductive layer is a polyester.

* * * * *